US006692354B2

(12) United States Patent
Tracy et al.

(10) Patent No.: US 6,692,354 B2
(45) Date of Patent: Feb. 17, 2004

(54) METHOD OF PLAYING A GROUP PARTICIPATION GAME

(75) Inventors: Joseph J. Tracy, Westminster, MD (US); Mark Guthrie Meyer, Phoenix, MD (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 10/165,227

(22) Filed: Jun. 7, 2002

(65) Prior Publication Data

US 2002/0151342 A1 Oct. 17, 2002

Related U.S. Application Data

(63) Continuation of application No. 09/339,076, filed on Jun. 23, 1999, now Pat. No. 6,416,408, which is a continuation-in-part of application No. 09/106,659, filed on Jun. 29, 1998.

(51) Int. Cl.[7] ..... A63F 9/22

(52) U.S. Cl. ..... 463/16; 463/17; 463/18; 463/19

(58) Field of Search ..... 463/16–22, 25–28; 273/269, 274, 139, 138.1, 138.2, 143 R, 454, 460

(56) References Cited

U.S. PATENT DOCUMENTS

| | | | | |
|---|---|---|---|---|
| 4,805,907 A | | 2/1989 | Hagiwara | 273/138 A |
| 4,961,578 A | * | 10/1990 | Chateau | 273/144 R |
| 4,998,199 A | | 3/1991 | Tashiro et al. | 364/410 |
| 5,112,050 A | * | 5/1992 | Koza et al. | 273/139 |
| 5,116,049 A | | 5/1992 | Sludikoff et al. | 273/139 |
| 5,186,463 A | | 2/1993 | Marin et al. | 273/138 R |
| 5,232,221 A | | 8/1993 | Sludikoff et al. | 273/139 |
| 5,259,616 A | | 11/1993 | Bergmann | 273/138 A |
| 5,273,281 A | | 12/1993 | Lovell | 273/138 R |
| 5,332,219 A | | 7/1994 | Marnell, II et al. | 273/138 A |
| 5,342,049 A | | 8/1994 | Wichinsky et al. | 273/119 R |
| 5,380,007 A | | 1/1995 | Travis et al. | 273/138 A |
| 5,393,057 A | * | 2/1995 | Marnell, II | 273/85 CP |

(List continued on next page.)

FOREIGN PATENT DOCUMENTS

| | | |
|---|---|---|
| AU | 18428/92 | 12/1992 |
| AU | 21070/92 | 10/1993 |
| AU | 52499/96 | 2/1997 |
| AU | 199716432 B2 | 9/1997 |
| AU | 50327/96 | 10/1997 |
| AU | 45403/97 | 6/1998 |
| AU | 63553/98 | 10/1998 |
| DE | 30 35 898 A1 | 4/1982 |
| DE | 30 35 947 A1 | 5/1982 |
| DE | 29 38 307 C2 | 6/1982 |

(List continued on next page.)

OTHER PUBLICATIONS

"Are you in?," flyer facsimile transmission from Maryland Lottery to Hagerstown Mini Storage, 2 pages, transmission date of Feb. 20, 1998.

(List continued on next page.)

*Primary Examiner*—S. Thomas Hughes
*Assistant Examiner*—Carmen D. White
(74) *Attorney, Agent, or Firm*—Marshall, Gerstein & Borun LLP

(57) ABSTRACT

A group wagering game is provided in which all entrants win or lose simultaneously as a group. The method of playing the game includes forming a group consisting of all entrants who have made a first wager on a first game and a second wager on the outcome of second group game. The outcome of the second group game is determined first, but is only applied if the first game is a winner. As such, a "bonus" round of play is provided which generates group interest and excitement in the gaming experience.

26 Claims, 3 Drawing Sheets

U.S. PATENT DOCUMENTS

| | | | | | |
|---|---|---|---|---|---|
| 5,401,024 | A | | 3/1995 | Simunek | 273/138 A |
| 5,451,052 | A | | 9/1995 | Behm et al. | 273/139 |
| 5,456,465 | A | | 10/1995 | Durham | 273/138 A |
| 5,486,005 | A | | 1/1996 | Neal | 273/292 |
| 5,513,846 | A | | 5/1996 | Niederlein et al. | 273/143 R |
| 5,540,442 | A | | 7/1996 | Orselli et al. | 463/17 |
| 5,564,700 | A | | 10/1996 | Celona | 463/27 |
| 5,655,961 | A | | 8/1997 | Acres et al. | 463/27 |
| 5,722,891 | A | | 3/1998 | Inoue | 463/20 |
| 5,732,948 | A | | 3/1998 | Yoseloff | 273/274 |
| 5,741,183 | A | | 4/1998 | Acres et al. | 463/42 |
| 5,743,800 | A | | 4/1998 | Huard et al. | 463/26 |
| 5,752,882 | A | | 5/1998 | Acres et al. | 463/42 |
| 5,770,533 | A | | 6/1998 | Franchi | 463/42 |
| 5,772,509 | A | * | 6/1998 | Weiss | 463/16 |
| RE35,864 | E | | 7/1998 | Weingardt | 463/28 |
| 5,797,794 | A | * | 8/1998 | Angell | 463/18 |
| 5,820,459 | A | | 10/1998 | Acres et al. | 463/25 |
| 5,823,874 | A | | 10/1998 | Adams | 463/17 |
| 5,830,063 | A | * | 11/1998 | Byrne | 463/18 |
| 5,833,537 | A | * | 11/1998 | Barrie | 463/21 |
| 5,836,817 | A | | 11/1998 | Acres et al. | 463/26 |
| 5,848,932 | A | | 12/1998 | Adams | 463/20 |
| 5,876,284 | A | | 3/1999 | Acres et al. | 463/25 |
| 5,882,261 | A | | 3/1999 | Adams | 463/20 |
| 5,911,418 | A | | 6/1999 | Adams | 273/274 |
| 5,996,997 | A | | 12/1999 | Kamille | 273/139 |
| 6,004,207 | A | | 12/1999 | Wilson, Jr. et al. | 463/20 |
| 6,012,982 | A | | 1/2000 | Piechowiak et al. | 463/16 |
| 6,077,162 | A | | 6/2000 | Weiss | 463/26 |
| 6,089,978 | A | | 7/2000 | Adams | 463/20 |
| 6,142,872 | A | | 11/2000 | Walker et al. | 463/16 |
| 6,149,521 | A | | 11/2000 | Sanduski | 463/13 |
| 6,179,710 | B1 | | 1/2001 | Sawyer et al. | 463/16 |
| 6,217,448 | B1 | | 4/2001 | Olsen | 463/25 |
| 6,227,969 | B1 | | 5/2001 | Yoseloff | 463/13 |
| 6,238,288 | B1 | | 5/2001 | Walker et al. | 463/26 |
| 6,309,300 | B1 | | 10/2001 | Glavich | 463/26 |
| 6,334,814 | B1 | | 1/2002 | Adams | 463/20 |
| 6,340,158 | B2 | | 1/2002 | Pierce et al. | 273/138.1 |
| 6,375,568 | B1 | | 4/2002 | Roffman et al. | 463/26 |
| 6,419,579 | B1 | | 7/2002 | Bennett | 463/20 |

FOREIGN PATENT DOCUMENTS

| | | | |
|---|---|---|---|
| DE | 34 15 114 | A1 | 10/1985 |
| DE | 29 38 307 | C3 | 7/1987 |
| DE | 38 22 636 | A1 | 1/1990 |
| DE | 197 06 286 | A1 | 5/1998 |
| DE | 298 03 107 | U1 | 9/1998 |
| DE | 298 16 453 | U1 | 4/1999 |
| DE | 197 51 746 | A1 | 5/1999 |
| EP | 0 798 676 | A1 | 10/1997 |
| EP | 0 874 337 | A1 | 10/1998 |
| EP | 0 896 304 | A2 | 2/1999 |
| EP | 0 919 965 | A2 | 6/1999 |
| ES | 529535 | | 6/1983 |
| ES | 529536 | | 6/1983 |
| ES | 2 006 400 | | 4/1989 |
| ES | 2 006 401 | | 4/1999 |
| GB | 2 230 373 | A | 10/1990 |
| GB | 2 222 712 | | 6/1992 |
| GB | 2 295 775 | A | 6/1996 |
| GB | 2 328 311 | A | 2/1999 |
| WO | WO 91/17529 | | 11/1991 |
| WO | WO 98/40138 | | 9/1998 |

OTHER PUBLICATIONS

Website entitled "Oregon Lottery Megabucks—How to play" last updated on Jul. 31, 2000 located at http://www.oregonlottery.org/mega/mhowto.htm.

* cited by examiner

METHOD OF PLAYING A GROUP PARTICIPATION GAME

CROSS-REFERENCE TO RELATED APPLICATIONS

This is a Continuation of U.S. application Ser. No. 09/339,076, now U.S. Pat. No. 6,416,408 filed Jun. 23, 1999, which is a continuation-in-part of and claims the benefit of U.S. patent application Ser. No. 09/106,659, filed Jun. 29, 1998.

STATEMENT REGARDING FEDERALLY SPONSORED RESEARCH OR DEVELOPMENT

"Not Applicable".

BACKGROUND OF THE INVENTION

This invention relates generally to games of chance, and more particularly to a method of playing a group wagering game in which all entrants win or lose simultaneously as a group.

In known wagering games, each individual entrant places a wager on the outcome of an event such as a roll of dice, a selection of one or more randomly generated indicia such as cards or numbers, a horse or dog race, a Jai Alai game, a sporting event, or the like, and the wager is won or lost depending on the outcome of the event. Typically, entrants are able to place their wagers on one or more of several possible outcomes of an event such that the actual outcome creates both winners and losers among the group of entrants of a particular game.

Some wagering games are designed around a particular apparatus such that the entrants must seek out a gaming table or machine in order to play. Other games can be played anywhere people are gathered and wagering is available. Regardless of the game being played or the venue in which it is presented for wagering, there is a need for a gaming method that will attract new entrants to wagering games and hold the attention of existing entrants so that such games remain attractive relative to the many new games and diversions constantly being developed.

Because the development of new games and diversions is costly and time consuming without any certain outcome of whether the game will be accepted by the gaming public, the use of a bonus feature on established and accepted games is desirable. Bonus features take many forms. For example, in U.S. Pat. No. 5,823,874 to Adams, a player may qualify for a bonus game on a gaming machine after achieving a predetermined winning outcome. Since this bonus feature is only available to those players who achieve the predetermined winning outcome, a player who has not achieved the bonus initiating winning outcome typically becomes bored and is more likely to cease playing the game. There is, therefore, a need to provide a bonus game in which a bonus or winning outcome is established prior to the initiation of the primary individual event and in which the bonus is awarded to all subsequent winning combinations of the primary event.

BRIEF SUMMARY OF THE INVENTION

In one aspect, the invention is directed to a gaming apparatus for allowing a plurality of entrants to participate in a primary game and a secondary game, wherein each entrant may make an entry and place a primary wager in connection with the primary game, and wherein a subset of the entrants may each place a secondary wager in connection with the secondary game associated with the primary game. The gaming apparatus may include at least one display device capable of displaying images associated with the primary game and the secondary game, and a central processing unit operatively coupled to the display device. The central processing unit may be programmed to determine a primary game outcome for the primary game, to cause the display device to display images corresponding to the primary game outcome for the primary game, to compare the primary game outcome for the primary game to the entry of each entrant for the primary game, and to determine whether each entrant has a winning entry for the primary game based on the comparison of the primary game outcome to the entry of each entrant.

The central processing unit may be further programmed to determine a primary game award amount for each entrant determined by the central processing unit to have a winning entry for the primary game, to determine a secondary game outcome for the secondary game associated with the primary game, wherein the secondary game outcome may have an associated multiplier value, and to cause the display device to display images corresponding to the multiplier value for the secondary game. Still further, the central processing unit may be programmed to determine a secondary game award amount for each entrant that placed a secondary wager on the secondary game associated with the primary game and that is determined by the central processing unit to have a winning entry for the primary game, wherein the secondary game award amount may be equal to the product of the primary game award amount multiplied by the multiplier value.

In another aspect, the invention is directed to a method of conducting a group participation wagering game in combination with an individual participation wagering game. The method may include receiving entries from a plurality of entrants wherein each of the entrants may have made a first wager on an outcome of the individual participation wagering game and a second wager to participate in the group participation wagering game, and determining whether a winning outcome is achieved for each entrant in the individual participation wagering game wherein if a winning outcome is achieved by an entrant in the individual participation wagering game, an individual prize amount may be determined for the entrant. The method may further include allocating a multiplier value to the group participation wagering game, wherein the multiplier value may be allocated from a plurality of multiplier values capable of being applied to the individual prize amount for each entrant achieving a winning outcome, and determining a total prize amount for each entrant achieving a winning outcome in the individual participation wagering game, wherein the total prize amount for each entrant may be equal to the entrant's individual prize amount multiplied by the multiplier value.

In a further aspect, the invention is directed to a method for conducting a primary game in combination with a secondary game. The method may include receiving an entry and a primary wager for the primary game from a plurality of entrants, wherein each entry made by one of the plurality of entrants for the primary game may include a first subset of primary game indicia selected from a set of primary game indicia, and may include receiving a secondary wager for the secondary game associated with the primary game from at least one of the entrants. The method may further include determining a primary game outcome for the primary game, wherein the primary game outcome for the primary game may include a second subset of primary game indicia selected from the set of primary game indicia, comparing the second subset of primary game indicia for the primary game to the first subset of primary game indicia for the primary game for each entrant, and determining a primary game award amount for each entrant for the primary game that may be based on a level of correspondence between the first subset of primary game indicia for the entrant and the second subset of primary game indicia for the primary game. Still further, the method may include determining a secondary game outcome for the secondary game associated with the primary game, wherein the secondary game outcome may have an associated multiplier value, and determining a secondary game award amount for each of the plurality of entrants that placed a secondary wager on the secondary game associated with the primary game and that is determined to have a winning entry for the primary game, wherein the secondary game award amount may be equal to the product of the primary game award amount multiplied by the multiplier value.

In a still further aspect, the invention is directed to a method for allowing a plurality of entrants to participate in a primary game and a secondary game. The method may include receiving an entry and a primary wager for the primary game from the plurality of entrants, receiving a secondary wager for the secondary game associated with the primary game from a subset of the entrants, determining a primary game outcome for the primary game, and comparing the primary game outcome for the primary game to the entry of each entrant for the primary game. The method may also include determining whether each entrant has a winning entry for the primary game based on the comparison of the primary game outcome to the entry of each entrant, determining a primary game award amount for each entrant determined to have a winning entry for the primary game, and determining a secondary game outcome for the secondary game associated with the primary game, wherein the secondary game outcome may have an associated multiplier value. Still further, the method may include determining a secondary game award amount for each of the plurality of entrants that placed a secondary wager on the secondary game associated with the primary game and that is determined to have a winning entry for the associated primary game, wherein the secondary game award amount may be equal to the product of the primary game award amount multiplied by the multiplier value.

Additionally, in another aspect, the invention is directed to a method for conducting a primary game in combination with a secondary game. The method may include receiving an entry and a primary wager for the primary game from a plurality of entrants, wherein each entry made by one of the plurality of entrants for the primary game may include at least one and at most ten indicia selected from a range of 80 indicia, receiving a secondary wager for the secondary game associated with the primary game from at least one of the entrants, and determining a primary game outcome for the primary game, wherein the primary game outcome for the primary game may include twenty indicia from the range of 80 indicia. The method may further include comparing the twenty indicia for the primary game outcome to the indicia of the entry for each entrant, determining a primary game award amount for each entrant for the primary game that may be based on a level of correspondence between the indicia for the entry for each entrant and the twenty indicia for the primary game outcome, and determining a secondary game outcome for the secondary game associated with the primary game, wherein the secondary game outcome may have an associated multiplier value. Still further, the method may include determining a secondary game award amount for each of the plurality of entrants that placed a secondary wager on the secondary game associated with the primary game and that is determined to have a winning entry for the primary game, wherein the secondary game award amount may be equal to the product of the primary game award amount multiplied by the multiplier value.

In yet another aspect, the invention is directed to a method for conducting individual participation Keno game in combination with a group game. The method may include receiving an entry and a first wager for the individual participation Keno game from a plurality of entrants, receiving a second wager for the group game associated with the individual participation Keno game from at least one of the entrants, and determining an individual participation Keno game outcome for the individual participation Keno game. The method may also include comparing the individual participation Keno game outcome to the entry for the individual participation Keno game for each entrant, determining an individual participation Keno game award amount for each entrant for the individual participation Keno game that may be based on a level of correspondence between the entry for the entrant and the individual participation Keno game outcome, and determining a group game outcome for the group game associated with the individual participation Keno game, wherein the group game outcome may have an associated multiplier value. The method may further include determining a group game award amount for each of the plurality of entrants that placed a second wager on the group game associated with the individual participation Keno game and that is determined to have a winning entry for the individual participation Keno game, wherein the second game award amount may be equal to the product of the individual participation Keno game award amount multiplied by the multiplier value.

Still further, in another aspect, the invention is directed to a method for conducting a primary game in combination with a secondary game. The method may include receiving an entry and a primary wager for the primary game from a plurality of entrants, wherein each entry made by one of the plurality of entrants for the primary game may include a first subset of primary game indicia selected from a set of primary game indicia, receiving a secondary wager for the secondary game associated with the primary game from at least one of the entrants, and determining a primary game outcome for the primary game, wherein the primary game outcome for the primary game may include a second subset of primary game indicia selected from the set of primary game indicia, and wherein the second subset of primary game indicia may be selected using a blower-type apparatus adapted for use with balls having primary game indicia disposed thereon. The method may also include comparing the second subset of primary game indicia for the primary game to the first subset of primary game indicia for the primary game for each entrant, determining a primary game award amount for each entrant for the primary game that may be based on a level of correspondence between the first subset of primary game indicia for the entrant and the second subset of primary game indicia for the primary game, and determining a secondary game outcome for the secondary game associated with the primary game, wherein the secondary game outcome may have an associated multiplier value. Still further, the method may include determining a secondary game award amount for each of the plurality of entrants that placed a secondary wager on the secondary game associated with the primary game and that is determined to have a winning entry for the primary game, wherein the secondary game award amount may be equal to the product of the primary game award amount multiplied by the multiplier value.

BRIEF DESCRIPTION OF THE SEVERAL VIEWS OF THE DRAWING

The preferred embodiment of the present invention is described in detail below with reference to the attached drawing, wherein.

DETAILED DESCRIPTION OF THE INVENTION

Figure 1:
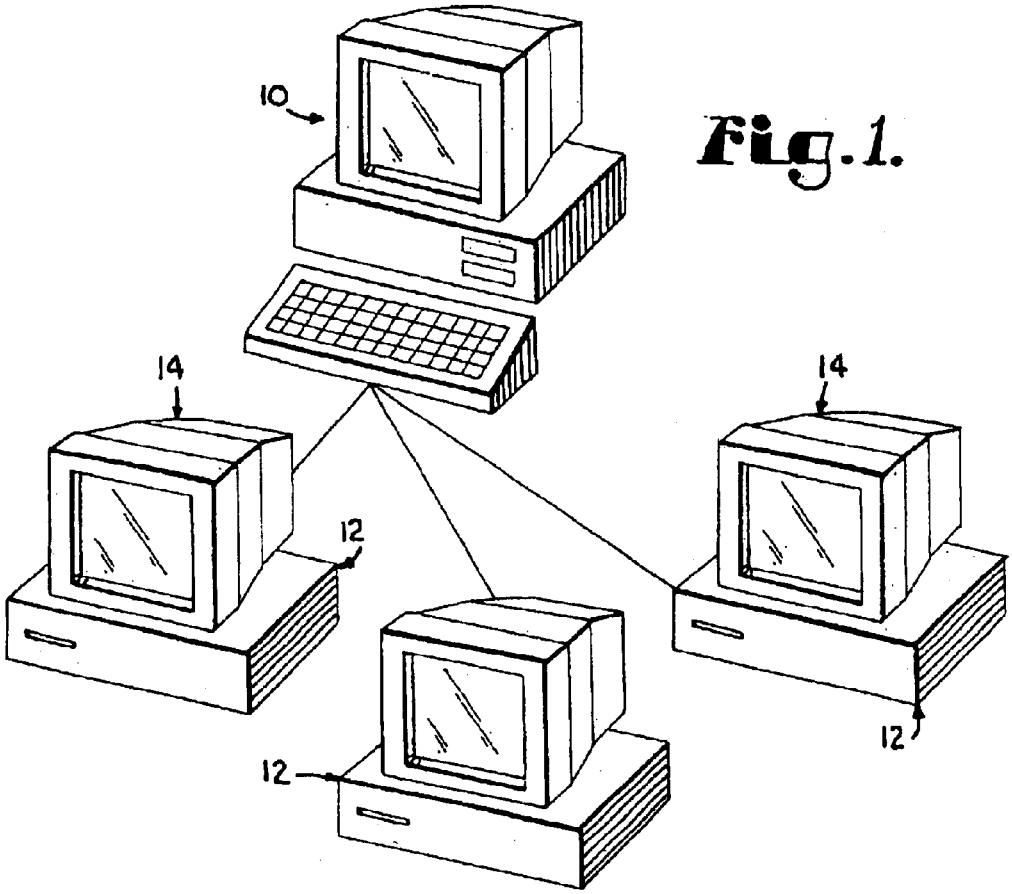
FIG. 1 is a schematic view of an apparatus for use in hosting a group wagering game in accordance with the preferred embodiment.

An apparatus capable of being used in hosting a group participation game in accordance with the preferred embodiment of the present invention is illustrated in FIG. 1, and includes a central processing unit 10 for generating random numbers or other indicia and transmitting the generated indicia to plural remote receivers 12, and a monitor or display 14 associated with each receiver for displaying the indicia and providing an indication of the outcome of the game. In addition, the receiver may form a part of a processing unit, such as a conventional interactive compact disk player or the like, for driving the display 14 so that entrants can observe the game in progress and witness the outcome thereof from various remote sites such as restaurants, taverns and gathering spots. Preferably, the central processing unit 10 includes software for generating the random numbers or indicia and for encoding the generated indicia for transmission to the various receivers, and the remote receivers associated with the displays include software for decoding the transmission and for driving the displays.

It is understood that the apparatus shown in FIG. 1 is provided for illustrative purposes only, and that the game of the present invention need not be hosted using any particular apparatus but may instead be carried out by any suitable electronic, mechanical or manual device as would be evident by a reading of the following description. For example, it is possible to employ a number generator in the form of a conventional blower-type apparatus adapted for use with ping pong balls, on which indicia are printed, for randomly generating the indicia, and a manual or mechanical display can be used at one or more locations to display the drawn indicia so that the group of entrants can monitor the progress of the game and determine whether the group is a winner or a loser. As such, the apparatus shown and described does not in any way limit the scope of the present invention, but merely represents one mode for carrying out the game.

Figure 2:
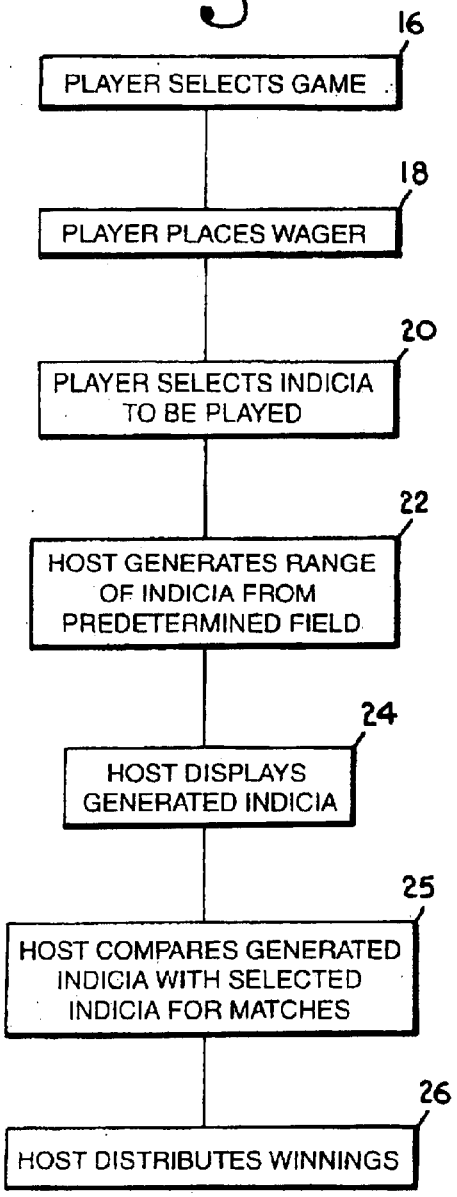
FIG. 2 is a flow chart of a method of playing a keno game to be used in combination with the group participation game.

In accordance with multiple embodiments of the preferred game, the group game is combined with an individual participation keno game. As shown in FIG. 2, the keno game is played by allowing entrants at 16 to select the number of "spots" to be played in a given game of keno, and at 18 to place a wager on the outcome of a random drawing of a predetermined range of indicia or numbers out of a large field, e.g. a drawing of 20 indicia out of a field of 80. If desired, an option may be provided whereby the entrant can allow the host to select his indicia automatically. At 20, the player selects the particular indicia or numbers to be played, and at 22 the central processing unit randomly draws the range of indicia from the field, and these indicia are encoded and transmitted to the various remote receivers where they are decoded and displayed, as at step 24. The individual entrants are thus able to watch as the generated range of indicia are displayed so that they can monitor their individual results and determine whether they are a winner or loser in the game. If they are a winner, they turn in their game card, which they filled out when placing their wager, and the indicia they selected are compared with the range for matches at 25.

If at least some of the numbers selected by the entrant are among the numbers in the range drawn from the field, the entrant wins a reward at 26. For example, the reward for selecting a single indicia that matches one of the 20 indicia drawn from a field of 80 might be $2, whereas the reward for selecting 10 indicia that match 10 of the 20 indicia drawn from the same field might be $100,000. If all of the numbers selected by the entrant are not among the range drawn from the field, a smaller percentage of correct selections wins. Thus, if an entrant selected 10 indicia and 5 of them match indicia drawn from the field, a prize of $2 might be rewarded.

Figure 3:
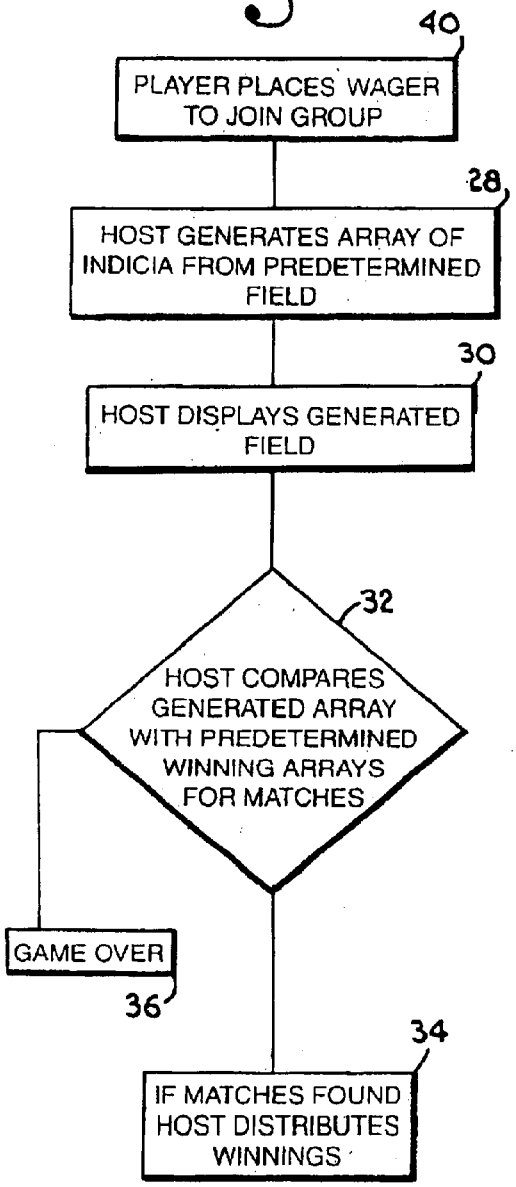
FIG. 3 is a flow chart of the method of the group participation game of the present invention.

The keno game is combined with the first embodiment group game of the present invention by allowing an individual to enter the group participation game at the same time he or she enters the keno game. For example, at 16, each entrant is given the opportunity not only to enter the keno game, but also to enter the group participation game, and at 18, an entry fee is paid for each of the games entered. Entrants are not required or allowed to make any selection or prediction of a particular winning combination, and all entrants have the identical odds of winning the game. If the group game is selected and a wager made, then after the keno game is over, the group game is played. With reference to FIG. 3, at 28, the same unit 10 used to play the keno game can be used to randomly generate indicia that is transmitted to the various receivers and displayed at 30. If a comparison of the generated indicia at step 32, reveals a match, then the group is a winner and each entrant is awarded a specified prize for each unit of his or her wager, as at 34. However, if no match is made, the group is a loser, as shown in step 36, and all wagers revert to the operator of the game.

Figure 4:
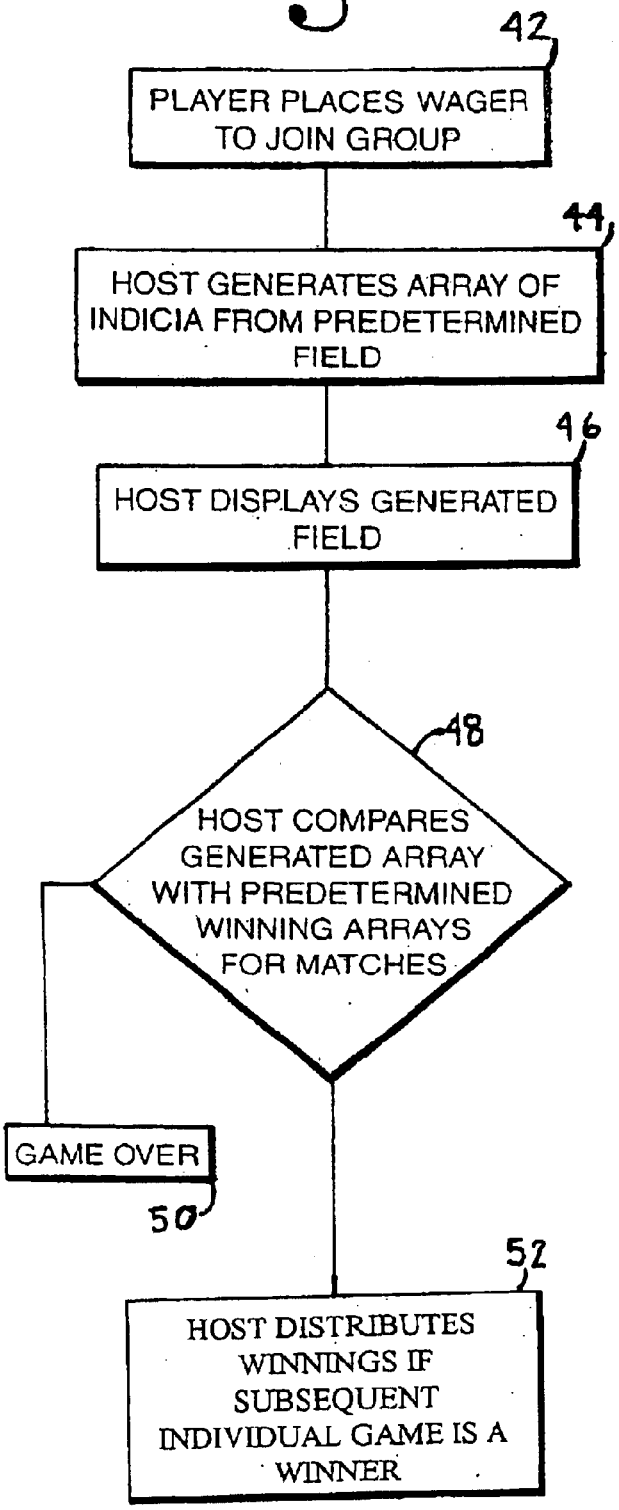
FIG. 4 is a flow chart of a method of the preferred group participation game.

Similar to the first embodiment, the keno game, described in FIG. 2 and explained above, is combined with the second embodiment group game by allowing an individual to enter the group participation game at the same time he or she enters the Keno game at 42. However, the bonus game is played prior to playing the individual game. With reference to FIG. 4 at 44, the same unit 10 used to play the keno game can be used to randomly generate indicia that is transmitted to the various receivers and displayed at 46. If a comparison of the generated indicia, at step 48, reveals a match, the group is a winner and each entrant is awarded the same prize if they have entered the wager and the entrant is a subsequent winner of the individual game as illustrated at 52. However, if no match is made, the group is a loser, as shown in 50, and all wagers revert to the operator of the game. Nevertheless, even if the entrant is a loser of the group game, he or she is still eligible to play and win the individual keno game.

Figure 5:
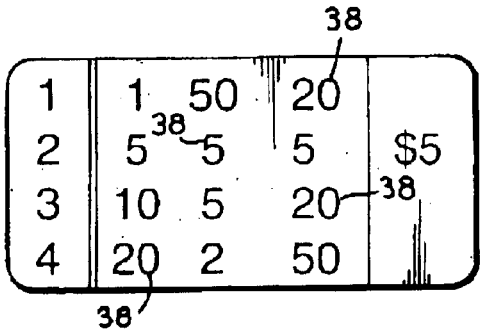
FIG. 5 is a plan view of a display indicating the outcome of a sample iteration of the group participation game.

A first embodiment of an exemplary display of the outcome of a group participation game is shown in FIG. 5, and includes an array made up of a plurality of rows and columns in which the randomly generated indicia 38 are displayed. Along the left side of the array are numbers indicating the game or row numbers in the array, and along the right side of the array is a column in which the winnings, if any, are displayed.

The indicia 38 generated and displayed in the group game preferably represent multipliers of the wager made by each player, and the odds of a given multiplier correspond to the magnitude of the multiplier. For example, if the multipliers 1, 2, 5, 10, 20 and 50 represent the field from which the range of indicia generated are to be selected, the odds of generating a 1 are far greater than those of generating a 50. One method employed to accomplish this weighted drawing is to employ a large field of numbers, and to assign each multiplier to a predetermined range of numbers, wherein the range of numbers assigned to the larger multipliers is substantially smaller than the range assigned to smaller multipliers. For example, if a field of 1000 numbers is used to generate the 6 multipliers noted, a multiplier of 1 would be generated if any number between 1 and 500 is drawn. Likewise, a multiplier of 2 would be generated if any number between 501 and 750 is drawn, a multiplier of 5 would be generated if a number between 751 and 850 is drawn, a multiplier of 10 would be generated if a number of between 851 and 900 is drawn, etc.

The multipliers generated during the game are displayed at random locations within the array, as dictated by the central processing unit, and are displayed one-by-one within the array so that all entrants can monitor the progress of the game and anticipate whether the group will win or lose. In the illustrated embodiment, the group wins if the three multipliers in any given row of the array match one another, and the group loses if the multipliers in all of the rows of the array fail to include all matching multipliers. Thus, as shown in FIG. 5, by generating the multiplier 5 for all three columns of row 2 of the array, winnings of $5 are awarded to all entrants who wagered on the group game.

In accordance with another aspect of the first embodiment of the outcome display of the game, the indicia 38 generated during the game can be numbers, pictures, playing cards, dice or other indicia representative of actual dollar amounts to be paid to all entrants, or they can be symbols or other indicia that must be arranged in a predetermined array or order to represent a winner for the group. In any event, a characteristic feature of the group game is the simultaneous observation of the game by all entrants gathered at each display so that a group excitement of anticipation is generated that draws people to the game and keeps their attention.

A second embodiment of the exemplary display outcome of a group participation game includes randomly generated indicia displayed to the players as payout multipliers on a wheel. To determine the outcome of the bonus game, the wheel is spun and the players anticipate whether a designator will point to a payout multiplier.

In an illustrative example, a wheel bearing 3, 4, 6 and 10 times payout multipliers is combined with a keno game. To qualify for the bonus round, a player indicates on the keno ticket that he or she wishes to participate in the group game and makes an additional wager. The wheel is spun and all the participants collectively anticipate whether the designator will point to a payout multiplier. For example, if the wheel lands on 3, then a player winning $10 in the keno game would collect $30. Likewise, if the wheel indicates 10, then the player collects $100. As would be understood, the indicia can take several forms including both mechanical and video representations.

Although the "bonus" nature of the game does not exist when it is offered independent of other games, it is possible to host the group game as a stand alone game. In order to play the game in this manner, a group is first formed at 40 of all individuals who enter the game by making a wager, a drawing is made at 28, and a determination is then made at 32, as to whether the group is a winner or loser. Thus, all entrants are able to simultaneously observe the game, and they win or lose as a group rather than as individuals. As with the combination game, none of the entrants is required or allowed to select indicia to play, but rather the entire group wins or loses with the same combinations, providing an environment in which every player is rooting for the same outcome as every other player.

Although the invention has been described with reference to the preferred embodiments illustrated in the attached drawing figures, it is noted that substitutions may be made and equivalents employed herein without departing from the scope of the invention as recited in the claims. For example, the group game can be employed in combination with games other than keno, such as bingo, a lottery, horse racing, dog racing, Jai Alai, table games, and gaming machines.

When the group game is combined with a bingo game, a separate blower is preferably provided along with predetermined quantities of bingo-type balls, wherein the numbers on the balls represent multipliers as described herein. A three-by-three array is displayed in which the randomly drawn balls are arranged, and the group of entrants in the game wins if the multipliers in any row, column or diagonal of the array match a predetermined winning combination. The group is formed of all entrants of the previous bingo game who made a wager on the outcome of the group game at the same time that they wagered on the bingo game.

When used in combination with a lottery game, the group game is conducted in conjunction with the lottery drawing in the same manner as it is conducted in combination with the keno game, with the group being formed of all entrants in the lottery who also made a wager on the outcome of the group game.

At the time an individual makes a wager on a dog race, horse race, Jai Alai game or other sporting event, they can also make a wager on a group game that is to be played during an intermission or between events. The group game is hosted as described herein, with multipliers or other indicia being generated and compared with a winning combination of indicia for a match. If such a match occurs, the group wins as a whole.

As gaming machines grow in popularity, and improvements to such machines are made, it is possible to provide a group gaming experience to individual players of such machines by combining the machine play with the group game of the present invention. An example of such a combination would include interrupting regular play of the machines at regular intervals in order to host a group game. Preferably, the group would include all machines that had maintained a predetermined level of play for the previous time interval such that this continued play would represent the wager required to enter the machine in the group game. Alternately, each player could be given the choice to either continue individual play or participate in a group game, the group for the group game would be formed of all those who indicated a desire to wager on the group game.

The particular game with which the group game is played can vary, as can the apparatus used to host the game and display the indicia being generated by the host. Such variations do not depart from the invention as claimed.

What is claimed is:

1. A gaming apparatus for allowing a plurality of entrants to participate in a primary game and a secondary game, wherein each entrant makes an entry and places a primary wager in connection with the primary game, and wherein a subset of the entrants each places a secondary wager in connection with the secondary game associated with the primary game, the gaming apparatus comprising:

at least one display device capable of displaying images associated with the primary game and the secondary game; and a central processing unit operatively coupled to the display device, the central processing unit being programmed to determine a primary game outcome for the primary game;

the central processing unit being programmed to cause the display device to display images corresponding to the primary game outcome for the primary game;

the central processing unit being programmed to compare the primary game outcome for the primary game to the entry of each entrant for the primary game, and to determine whether each entrant has a winning entry for the primary game based on the comparison of the primary game outcome to the entry of each entrant;

the central processing unit being programmed to determine a primary game award amount for each entrant determined by the central processing unit to have a winning entry for the primary game;

the central processing unit being programmed to determine a secondary game outcome for the secondary game associated with the primary game, the secondary game outcome having an associated multiplier value;

the central processing unit being programmed to cause the display device to display images corresponding to the multiplier value for the secondary game; and the central processing unit being programmed to determine a secondary game award amount for each entrant that placed a secondary wager on the secondary game associated with the primary game and that is determined by the central processing unit to have a winning entry for the primary game, the secondary game award amount being equal to the product of the primary game award amount multiplied by the multiplier value.

2. A gaming apparatus as defined in claim 1, wherein each entry made by an entrant for the primary game comprises at least one and at most ten indicia selected from a range of 80 indicia, wherein the primary game outcome for the primary game comprises twenty indicia selected from the range of 80 indicia, wherein the central processing unit is programmed to determine that an entry made by an entrant for the primary game is a winning entry by comparing the indicia of the entry to the twenty indicia of the primary game outcome for the primary game, and wherein the central processing unit determines that the entry is a winning entry based on the number of indicia of the entry that match the twenty indicia of the primary game outcome of the primary game.

3. A gaming apparatus as defined in claim 2, wherein the central processing unit is programmed to select the indicia of an entry of an entrant.

4. A gaming apparatus as defined in claim 1, wherein the central processing unit is disposed at a central location and the display device is disposed at a corresponding remote location.

5. A gaming apparatus as defined in claim 1, further comprising at least one remote receiver operatively coupled to the central processing unit, the remote receiver being operatively coupled to the display device, the central processing unit being adapted to transmit primary information corresponding to the primary game outcome of the primary game to the remote receiver, and the remote receiver being programmed to receive the primary information corresponding to the primary game outcome of the primary game and to cause the display device to display images corresponding to the primary game outcome of the primary game based on the received primary information.

6. A gaming apparatus as defined in claim 5, wherein the central processing unit is programmed to transmit secondary information corresponding to the secondary game outcome of the secondary game to the remote receiver, and wherein the remote receiver is programmed to receive the secondary information corresponding to the secondary game outcome of the secondary game and to cause the display device to display images corresponding to the secondary game outcome of the secondary game based on the received secondary information.

7. A gaming apparatus as defined in claim 1, wherein the central processing unit is programmed to determine a multiplier value that is greater than or equal to 1.

8. A gaming apparatus as defined in claim 1, wherein the central processing unit is programmed to determine the secondary game outcome for the secondary game associated with the primary game before determining the primary game outcome for the primary game.

9. A method of conducting a group participation wagering game in combination with an individual participation wagering game, the method comprising:

receiving entries from a plurality of entrants wherein each of the entrants has made a first wager on an outcome of the individual participation wagering game and a second wager to participate in the group participation wagering game;

determining whether a winning outcome is achieved for each entrant in the individual participation wagering game wherein if a winning outcome is achieved by an entrant in the individual participation wagering game, an individual prize amount is determined for the entrant;

allocating a multiplier value to the group participation wagering game, the multiplier value being allocated from a plurality of multiplier values capable of being applied to the individual prize amount for each entrant achieving a winning outcome; and determining a total prize amount for each entrant achieving a winning outcome in the individual participation wagering game, wherein the total prize amount for each entrant is equal to the entrant's individual prize amount multiplied by the multiplier value.

10. A method of conducting a group participation wagering game in combination with an individual participation wagering game as defined in claim 9, the method comprising receiving an entry from at least one additional entrant wherein the one additional entrant has made a first wager on an outcome of the individual participation wagering game and has not made a second wager to participate in the group participation wagering game, wherein the multiplier value is not applied to an individual prize amount for the one additional entrant where the one additional entrant is determined to have a winning outcome for the individual participation wagering game.

11. A method of conducting a group participation wagering game in combination with an individual participation wagering game as defined in claim 9, wherein each entry made by one of the plurality of entrants for the occurrence of the individual participation wagering game comprises at least one and at most ten indicia selected from a range of 80 indicia, wherein determining whether each entrant has a winning outcome comprises:

determining an individual participation game outcome by selecting twenty indicia from the range of 80 indicia;

comparing the indicia of the entry of the entrant to the twenty indicia of the individual participation game outcome for the individual participation wagering game; and determining if the entry of the entrant is a winning outcome based on the number of indicia of the entry that match the twenty indicia of the individual participation game outcome of the individual participation wagering game.

12. A method of conducting a group participation wagering game in combination with an individual participation wagering game as defined in claim 11, the method comprising selecting the indicia of an entry of at least one of the entrants at a central processing unit.

13. A method of conducting a group participation wagering game in combination with an individual participation wagering game as defined in claim 9, comprising allocating a multiplier value of greater than or equal to 1 to the group participation wagering game.

14. A method of conducting a group participation wagering game in combination with an individual participation wagering game as defined in claim 9, comprising allocating the multiplier value to the group participation wagering game before determining whether a winning outcome is achieved for each entrant in the individual participation wagering game.

15. A method for conducting a primary game in combination with a secondary game, the method comprising:

receiving an entry and a primary wager for the primary game from a plurality of entrants, each entry made by one of the plurality of entrants for the primary game comprising a first subset of primary game indicia selected from a set of primary game indicia;

receiving a secondary wager for the secondary game associated with the primary game from at least one of the entrants;

determining a primary game outcome for the primary game, the primary game outcome for the primary game comprising a second subset of primary game indicia selected from the set of primary game indicia;

comparing the second subset of primary game indicia for the primary game to the first subset of primary game indicia for the primary game for each entrant;

determining a primary game award amount for each entrant for the primary game based on a level of correspondence between the first subset of primary game indicia for the entrant and the second subset of primary game indicia for the primary game;

determining a secondary game outcome for the secondary game associated with the primary game, the secondary game outcome having an associated multiplier value; and determining a secondary game award amount for each of the plurality of entrants that placed a secondary wager on the secondary game associated with the primary game and that is determined to have a winning entry for the primary game, the secondary game award amount being equal to the product of the primary game award amount multiplied by the multiplier value.

16. A method for conducting a primary game in combination with a secondary game as defined in claim 15, wherein the first subset of primary game indicia comprises at least one and at most ten indicia selected from a range of 80 indicia, the second subset of primary game indicia comprises twenty indicia from the range of 80 indicia, the comparing step comprising comparing the indicia of the entry of the entrant to the twenty indicia for the primary game, wherein the entry of the entrant is a winning entry based on the number of the indicia of the entry that match the twenty indicia of the primary game.

17. A method for conducting a primary game in combination with a secondary game as defined in claim 15, comprising selecting the first subset of primary game indicia of an entry of at least one of the plurality of entrants at a central processing unit.

18. A method for conducting a primary game in combination with a secondary game as defined in claim 15, comprising allocating a multiplier value of greater than or equal to 1 to the secondary game outcome.

19. A method for conducting a primary game in combination with a secondary game as defined in claim 15, comprising determining the secondary game outcome for the secondary game associated with the primary game before determining the primary game outcome for the primary game.

20. A method for allowing a plurality of entrants to participate in a primary game and a secondary game, the method comprising:

receiving an entry and a primary wager for the primary game from the plurality of entrants;

receiving a secondary wager for the secondary game associated with the primary game from a subset of the entrants;

determining a primary game outcome for the primary game;

comparing the primary game outcome for the primary game to the entry of each entrant for the primary game;

determining whether each entrant has a winning entry for the primary game based on the comparison of the primary game outcome to the entry of each entrant;

determining a primary game award amount for each entrant determined to have a winning entry for the primary game;

determining a secondary game outcome for the secondary game associated with the primary game, the secondary game outcome having an associated multiplier value; and determining a secondary game award amount for each of the plurality of entrants that placed a secondary wager on the secondary game associated with the primary game and that is determined to have a winning entry for the associated primary game, the secondary game award amount being equal to the product of the primary game award amount multiplied by the multiplier value.

21. A method for allowing a plurality of entrants to participate in a primary game and a secondary game as defined in claim 20, wherein each entry made by one of the plurality of entrants for the primary game comprises at least one and at most ten indicia selected from a range of 80 indicia, wherein the primary game outcome for the primary game comprises twenty indicia selected from the range of 80 indicia, wherein determining whether each entrant has a winning entry comprises comparing the indicia of the entry to the twenty indicia of the primary outcome for the primary game, wherein the entry is a winning entry based on the number of the indicia of the entry that match the twenty indicia of the primary outcome of the primary game.

22. A method for allowing a plurality of entrants to participate in a primary game and a secondary game as defined in claim 21, the method comprising selecting the indicia of an entry of at least one of the plurality of entrants at a central processing unit.

23. A method for allowing a plurality of entrants to participate in a primary game and a secondary game as defined in claim 20, comprising determining the secondary game outcome for the secondary game associated with the primary game before determining the primary game outcome for the primary game.

24. A method for conducting a primary game in combination with a secondary game, the method comprising:

receiving an entry and a primary wager for the primary game from a plurality of entrants, each entry made by one of the plurality of entrants for the primary game comprising at least one and at most ten indicia selected from a range of 80 indicia;

receiving a secondary wager for the secondary game associated with the primary game from at least one of the entrants;

determining a primary game outcome for the primary game, the primary game outcome for the primary game comprising twenty indicia selected from the range of 80 indicia;

comparing the twenty indicia for the primary game outcome to the indicia of the entry for each entrant;

determining a primary game award amount for each entrant for the primary game based on a level of correspondence between the indicia for the entry for each entrant and the twenty indicia for the primary game outcome;

determining a secondary game outcome for the secondary game associated with the primary game, the secondary game outcome having an associated multiplier value; and determining a secondary game award amount for each of the plurality of entrants that placed a secondary wager on the secondary game associated with the primary game and that is determined to have a winning entry for the primary game, the secondary game award amount being equal to the product of the primary game award amount multiplied by the multiplier value.

25. A method for conducting individual participation Keno game in combination with a group game, the method comprising:

receiving an entry and a first wager for the individual participation Keno game from a plurality of entrants;

receiving a second wager for the group game associated with the individual participation Keno game from at least one of the entrants;

determining an individual participation Keno game outcome for the individual participation Keno game;

comparing the individual participation Keno game outcome to the entry for the individual participation Keno game for each entrant;

determining an individual participation Keno game award amount for each entrant for the individual participation Keno game based on a level of correspondence between the entry for the entrant and the individual participation Keno game outcome;

determining a group game outcome for the group game associated with the individual participation Keno game, the group game outcome having an associated multiplier value; and determining a group game award amount for each of the plurality of entrants that placed a second wager on the group game associated with the individual participation Keno game and that is determined to have a winning entry for the individual participation Keno game, the second game award amount being equal to the product of the individual participation Keno game award amount multiplied by the multiplier value.

26. A method for conducting a primary game in combination with a secondary game, the method comprising:

receiving an entry and a primary wager for the primary game from a plurality of entrants, each entry made by one of the plurality of entrants for the primary game comprising a first subset of primary game indicia selected from a set of primary game indicia;

receiving a secondary wager for the secondary game associated with the primary game from at least one of the entrants;

determining a primary game outcome for the primary game, the primary game outcome for the primary game comprising a second subset of primary game indicia selected from the set of primary game indicia, the second subset of primary game indicia being selected using a blower-type apparatus adapted for use with balls having primary game indicia disposed thereon;

comparing the second subset of primary game indicia for the primary game to the first subset of primary game indicia for the primary game for each entrant;

determining a primary game award amount for each entrant for the primary game based on a level of correspondence between the first subset of primary game indicia for the entrant and the second subset of primary game indicia for the primary game;

determining a secondary game outcome for the secondary game associated with the primary game, the secondary game outcome having an associated multiplier value; and determining a secondary game award amount for each of the plurality of entrants that placed a secondary wager on the secondary game associated with the primary game and that is determined to have a winning entry for the primary game, the secondary game award amount being equal to the product of the primary game award amount multiplied by the multiplier value.

* * * * *